US007980424B2

(12) United States Patent
Johnson

(10) Patent No.: US 7,980,424 B2
(45) Date of Patent: Jul. 19, 2011

(54) PIERCING FITMENT ASSEMBLY

(75) Inventor: James Johnson, Delaware, OH (US)

(73) Assignee: Liqui-Box Corporation, Worthington, OH (US)

( * ) Notice: Subject to any disclaimer, the term of this patent is extended or adjusted under 35 U.S.C. 154(b) by 314 days.

(21) Appl. No.: 11/888,133

(22) Filed: Jul. 31, 2007

(65) Prior Publication Data

US 2008/0029540 A1 Feb. 7, 2008

Related U.S. Application Data

(60) Provisional application No. 60/834,458, filed on Jul. 31, 2006.

(51) Int. Cl.
*B67D 5/00* (2006.01)

(52) U.S. Cl. ..... 222/83; 222/89; 222/105; 383/202

(58) Field of Classification Search ..... 222/83, 222/83.5, 80, 81, 89, 90, 91, 105; 383/202
See application file for complete search history.

(56) References Cited

U.S. PATENT DOCUMENTS

| | | | | |
|---|---|---|---|---|
| 3,474,933 | A | 10/1969 | Malpas | |
| 4,022,258 | A * | 5/1977 | Steidley | 141/330 |
| 4,325,496 | A | 4/1982 | Malpas | |
| 4,516,691 | A * | 5/1985 | Christine et al. | 222/83.5 |
| 4,624,392 | A * | 11/1986 | Malpas et al. | 222/83 |
| 4,765,511 | A | 8/1988 | Clements | |
| 5,102,010 | A | 4/1992 | Osgar et al. | |
| 5,205,440 | A | 4/1993 | Matsushita | |
| 5,337,775 | A * | 8/1994 | Lane et al. | 137/68.29 |
| 6,378,730 | B1 * | 4/2002 | Reddy et al. | 222/83 |
| 6,806,094 | B2 * | 10/2004 | Anderson et al. | 436/180 |
| 6,962,275 | B2 * | 11/2005 | deCler et al. | 222/570 |
| 6,971,548 | B2 * | 12/2005 | Smith | 222/83 |
| 2004/0104246 | A1 * | 6/2004 | Kawaguchi et al. | 222/83 |
| 2004/0178220 | A1 * | 9/2004 | Smith | 222/83 |
| 2004/0232175 | A1 * | 11/2004 | deCler et al. | 222/567 |
| 2005/0269354 | A1 * | 12/2005 | Smith | 222/83 |
| 2007/0205216 | A1 * | 9/2007 | Smith | 222/81 |

FOREIGN PATENT DOCUMENTS

| | | | |
|---|---|---|---|
| CA | 2321689 | | 10/1999 |
| GB | 2077243 | | 12/1981 |
| GB | 2116152 | * | 9/1983 |
| WO | WO2004096656 A1 | | 11/2004 |

OTHER PUBLICATIONS

PCT International Search Report for PCT/CA2007/001344.

* cited by examiner

*Primary Examiner* — Kevin P Shaver
*Assistant Examiner* — Donnell Long

(57) ABSTRACT

An improved piercing fitment assembly for mounting to a flexible container is provided, whereby the contents of the container are dispensed by piercing a pierceable portion of a cap using a fluid transfer device. The piercing fitment assembly is easy to use as a relatively minimal amount of force is required for piercing and establishing fluid transfer. It also has a locking system which locks the fluid transfer device into a dispensing state and also forms a reliable seal between the cap and the fluid transfer device which minimizes the risk of unwanted spillage. The fitment assembly comprises: a spout connected in fluid communication to the container; a cap having a pierceable portion sealing an end of the spout and a fluid transfer device having a leading tooth to initiate piercing of the pierceable portion of the cap.

18 Claims, 14 Drawing Sheets

PIERCING FITMENT ASSEMBLY

RELATED APPLICATION

This application claims the benefit of U.S. Provisional Application No. 60/834,458, filed on Jul. 31, 2006, entitled "A Piercing Fitment Assembly", with listed inventor, James W. Johnson. The entire teachings of the above application are incorporated herein by reference.

FIELD OF INVENTION

This invention relates to a piercing fitment assembly for use with flexible containers for flowable materials, such as liquids, and including aseptically-packaged flexible containers.

BACKGROUND OF THE INVENTION

Flexible polymeric containers are extensively used throughout the food service industry for storing and dispensing soft drink syrups and other such beverages, as well as wine, dairy products, enteral feeding solutions, fruit juices, tea and coffee concentrates, puddings, cheese sauces, and many other flowable materials, including those that must be filled aseptically. Flexible polymeric containers typically have walls made of polymeric films with either a monolayer or multiple layer structure. The particular polymers constituting the container film layers vary depending on the type of material to be placed in the container. The film layers may also include an oxygen barrier material layer to prevent contact between such materials and oxygen or other gas sensitive contents. The walls of the containers may be metallized, or coated with a metallic layer such as aluminum to prevent incursion of oxygen or other gases.

The flexible polymeric containers may have inlets and/or spouts for filling and dispensing the container contents. The containers are also often placed within a corrugated paper box. Such packaging systems are commonly referred to as "bag-in-box" systems wherein the spout extends through an opening in the box to dispense the contents. Bag-in-box packaging systems are often used in restaurants, institutional food service centres, and convenience stores to facilitate service of liquid food products such as syrups, toppings, condiments, beverages and dairy products. These containers typically have a capacity of 1 to 6 gallons.

Once the container is filled with a desired flowable material, the spout is capped to seal the container and protect the contents from contamination. Depending on the type of contents, the container, spout and cap may be sterilized using steam, hydrogen peroxide ($H_2O_2$), radiation or other suitable sterilizing methods prior to, during and after filling. In order to maximize the shelf life of such products, it is crucial that fitment assemblies provide a hermetic seal for the entire life cycle of the container.

One convenient method of dispensing the contents of flexible containers is to open the containers by piercing the cap used to seal the container or by piercing the container directly using a fluid transfer device. Examples of dispensing systems that use piercing are disclosed in the following U.S. Pat. Nos. 4,325,496, 6,971,548 and 6,378,730.

Since flexible containers are typically intended for one-time use and are discarded once the contents of such containers have been completely dispensed, the fitment assembly must be made of inexpensive material, easy to manufacture, quick to market and preferably recyclable. It is also desirable that the fitment assembly for use with such packaging systems simplifies access to the container's contents while also minimizing the potential for contamination of the contents. Preferably, the contents of the flexible containers can also be easily dispensed without tools or the like. It is also desirable that the fitment assembly can be adapted to standard and widely-used spout configurations and can be easily adapted to a flexible hose or tube. The dispensing mechanism must be reliable such that dispensing of the contents is achieved without wasting the liquid through leakage or uncontrolled opening of the connection component and the like.

SUMMARY OF INVENTION

Accordingly, the present invention provides a fitment assembly which can be mounted to a flexible container, whereby contents of the container are dispensed by piercing a portion of the cap using a fluid transfer device. The piercing fitment assembly is easy to use as a relatively minimal amount of force is required for piercing and establishing fluid transfer. It also has a locking system which locks the fluid transfer device into a dispensing state and also forms a reliable seal between the cap and the fluid transfer device which minimizes the risk of unwanted spillage.

The piercing fitment assembly may be used, for example, with flexible containers that are filled or that are formed and filled using suitable commercial packaging systems known in the art. Such packaging systems may include vertical form film seal filling machines sold under the trade-marks PREPAC, IMPACO and ELECSTER, and, the Liqui-Box™ Filler Model 2000C1T-A that is used for filling flexible containers used in bag-in-box systems. The fitment assembly may also be used with flexible containers that are aseptically filled.

According to one broad aspect, the present invention provides a fluid transfer device for dispensing flowable material from a container by piercing. The fluid transfer device comprises a hollow body having: a longitudinal axis, a through internal passage, a piercing end and a dispensing end. The piercing end has a peripheral extremity that is tapered in relation to the longitudinal axis of the hollow body and the piercing end also has a leading tooth that is located at a distal extrema of the peripheral extremity to initiate piercing of a cap secured to a spout of a container.

In another embodiment of the invention, the leading tooth may comprise an exterior surface that is substantially parallel to the longitudinal axis of the hollow body and an interior surface that is inclined inwardly and forms an angle of 10° to 45° with the exterior surface.

Advantageously, the piercing end of the fluid transfer device may further comprise a plurality of additional teeth that are disposed around the peripheral extremity. The additional teeth facilitate piercing as they reduce the amount of force that is required for piercing a pierceable portion of the cap of the spout of the container and cause a circular membrane within the pierceable portion to be peeled back in order to establish fluid transfer.

According to another aspect, the present invention also provides a cap for securing to a spout of a container. The cap comprises a spout receiving side adapted for securing the cap to the spout of the container and a pierceable portion adapted to be pierced by a fluid transfer device. The pierceable portion of the cap comprises an indentation defining a circular membrane surrounded by a plurality of petaloid elements. Advantageously, the pierceable portion may be located within a central opening of the cap and a barrier may be used to cover the central opening and hence the pierceable portion so as to keep the pierceable portion in a substantially sterile state prior to dispensing.

According to a further aspect, the present invention also provides a fitment assembly for a container. The fitment assembly comprises: a spout connected in fluid communication to the container; a cap sealing a dispensing end of the spout, the cap having a pierceable portion; and a fluid transfer device including a piercing end and a dispensing end. The fluid transfer device has a longitudinal axis and a through internal passage and is used for piercing the cap at the pierceable portion to permit fluid communication from the container through the spout and the fluid transfer device. The piercing end of the fluid transfer device includes a leading tooth to initiate piercing of the pierceable portion of the cap.

The piercing end of the fluid transfer device may have a peripheral extremity that is tapered in relation to the longitudinal axis of the fluid transfer device wherein the leading tooth is located at a distal extrema of the tapered peripheral extremity so as to initiate piercing of the pierceable portion of the cap during piercing. Advantageously, the piercing end may further comprise additional teeth disposed around the peripheral extremity of the piercing end so as to subsequently and progressively puncture the pierceable portion of the cap during piercing.

Preferably, the pierceable portion of the cap also comprises an indentation defining a circular membrane surrounded by a plurality of petaloid elements. Advantageously, the pierceable portion is further adapted to cooperate with the fluid transfer device such that the circular membrane remains attached to the cap by a hinge-like connection that is formed during piercing.

The fitment assembly may further comprise a locking mechanism adapted to secure the fluid transfer device to the cap as a result of a pushing force exerted on the fluid transfer device in an essentially axial direction within the spout, whereby the piercing end is in piercing engagement with the cap. The locking mechanism may comprise an annular recessed portion on the piercing end of the fluid transfer device adapted to cooperate with the petaloid elements of the pierceable portion of the cap so as to prevent removal of the fluid transfer device from the cap once the piercing fitment assembly is in a dispensing state and thereby prevent unwanted spillage.

According to another aspect, the present invention also provides a pierceable port for a flexible container comprising: a pierceable portion adapted to be pierced by a fluid transfer device. The pierceable portion comprises an indentation defining a circular membrane surrounded by a plurality of petaloid elements. The pierceable port can be secured to the flexible container. The pierceable port may further comprise a skirt extending outwardly from a container side of the pierceable port and surrounding the pierceable portion. The skirt serves as a spacer to keep any portion of any adjacent container wall away from the pierceable portion thereby preventing the container walls from being pierced by the fluid transfer device.

According to a further aspect, the present invention also provides a flexible container comprising the pierceable port described above. The pierceable port may be secured to the flexible container by a flange secured to a wall surface of the flexible container. The pierceable port may also be secured to the flexible container so that the pierceable portion is aligned with an opening in the flexible container. Alternatively, if the pierceable portion is not aligned with an opening in the flexible container and the flange is secured to an outside wall surface of the container, a portion of the pierceable portion may also be secured to the outside wall surface. This prevents excessive stretching of the container material in the area of the pierceable portion during piercing and allows the container to be pierced more easily by the fluid transfer device.

According to yet another aspect, the present invention also provides a fitment assembly for a container comprising a pierceable port and a fluid transfer device. The pierceable port is secured to a wall of the container and includes a pierceable portion. The port may include a flange by which it may be secured to the container. The fluid transfer device comprises a through internal passage, to permit fluid communication from the container through the fluid transfer device. The fluid transfer device may be of the type previously described.

DETAILED DESCRIPTION OF THE INVENTION

Referring particularly to the drawings, the figures are for the purpose of illustrating the present invention only and not for the purpose of limiting the scope of the appended claims.

Figure 1:
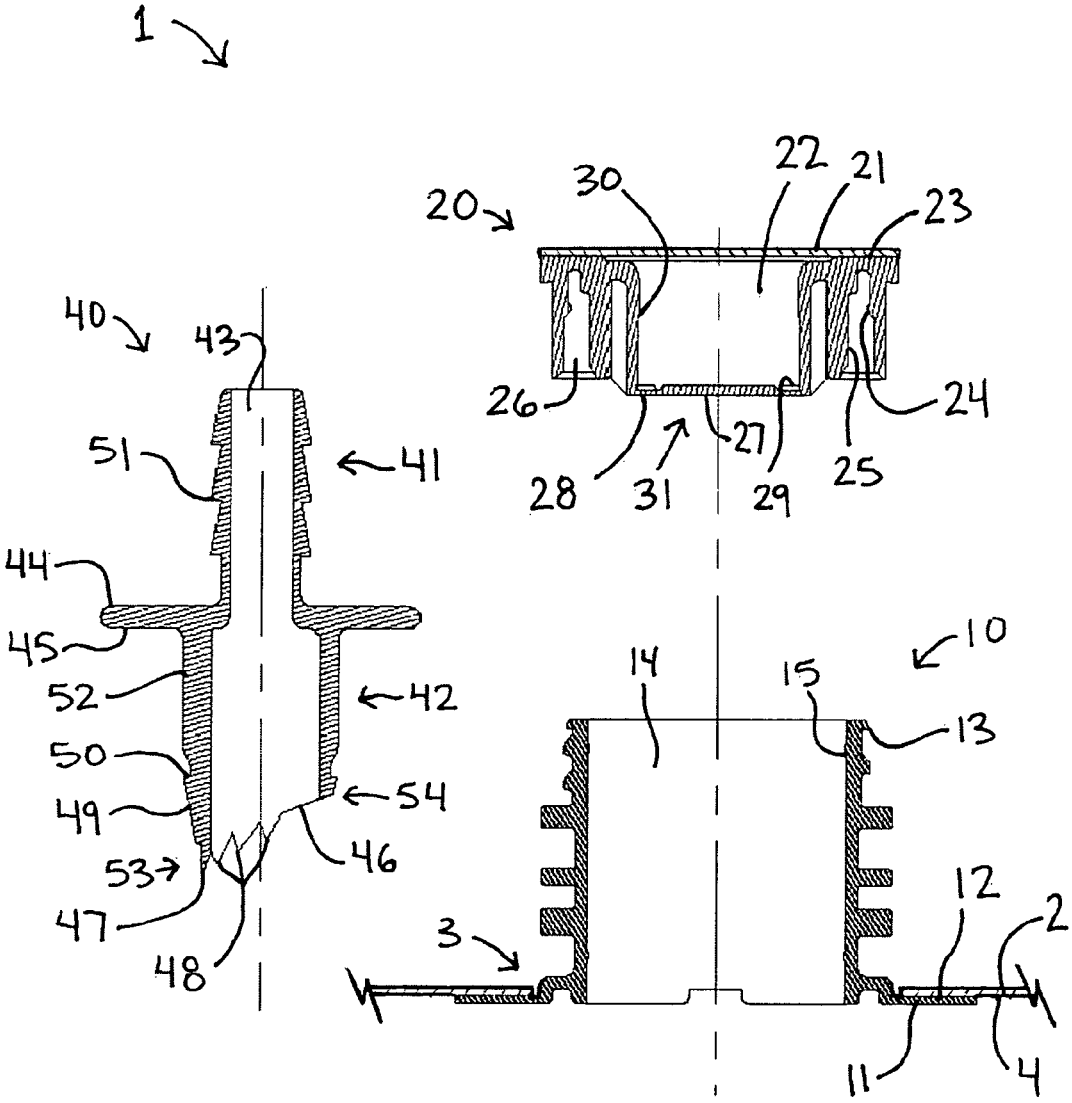
FIG. 1 shows a cross-sectional side elevation view of a piercing fitment assembly, in a disassembled state, according to one embodiment of the invention.

Referring now to FIG. 1, there is illustrated a piercing fitment assembly shown generally at 1 according to the invention for use with flexible containers for flowable materials, such as liquids, and particularly for aseptically-packaged flexible containers. The piercing fitment assembly 1 comprises a spout shown generally at 10 mounted to a flexible container 2, a cap shown generally at 20 and a fluid transfer device shown generally at 40.

The configuration of the spout 10 shown in FIG. 1 is widely-used, commercially available and is conventionally adapted for mounting to flexible containers such as bag-in-box containers, namely bags. However, it is understood that the piercing fitment assembly of the present invention could easily be modified to comprise other configurations of spouts. The spout 10 has a generally cylindrical shape and has a through central opening 14. The central opening 14 of the spout 10 is in communication with the container 2 (a top portion of which is shown) via an opening 3 in the container 2. At its base, the spout 10 also has a relatively thin outwardly projecting flange 11 that is used to secure the spout 10 to an inside wall surface 4 of the container 2. The top surface 12 of the flange 11 is bonded to form a hermetically sealed connection with the inside wall surface 4 of the container 2 by known means such as heat sealing, adhesive or the like.

Figure 4:
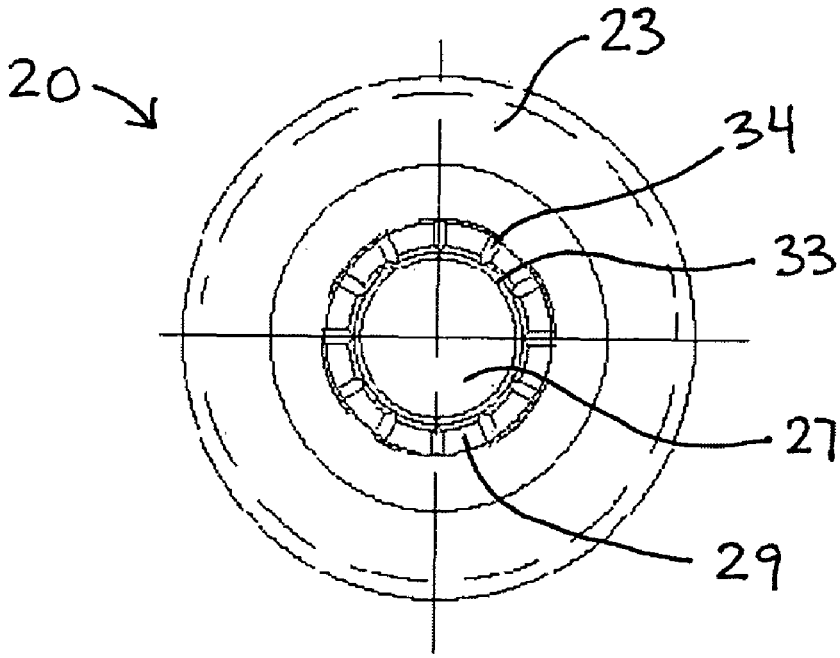
FIG. 4 shows a top plan view of the cap of the piercing fitment assembly of FIG. 1 without a barrier.

The cap 20 has a generally cylindrical shape but could be made to adapt other shapes of spouts such as oval or polygon-shaped. The cap 20 has a central opening 22 which has an interior circumferential surface 30. The cap 20 also has, within the central opening 22, a pierceable portion 31 which has an indentation which comprises a circular portion 33 and several radial portions 34 as shown in FIG. 4. The indentation formed by portions 33 and 34 is an area of reduced material thickness within the pierceable portion 31 which defines a circular membrane 27 surrounded by a plurality of petaloid elements 29 within the pierceable portion 31. The cap 20 also has an annular opening 26 which is adapted for receiving the spout 10 and hermetically securing the cap 20 to the spout 10. Located inside the annular opening 26 is an inside surface 25 and an annular bead 24. The cap 20 may further comprise a barrier 21 secured to a top surface 23 of the cap 20 for sealing the central opening 22.

The fluid transfer device 40 also has a generally cylindrical shape and comprises, a dispensing end shown generally at 41, a piercing end shown generally at 42, a through internal passage 43 and a handle 44 between the dispensing end 41 and the piercing end 42. The handle 44 comprises an outwardly projecting flange and has a bottom surface 45. The dispensing end 41 has a ribbed exterior portion 51 which is adapted to be secured to a dispensing tube (not shown). The piercing end 42 has an exterior cylindrical surface 52 and an annular recessed portion 50 which is part of a snap-fitting locking mechanism. The piercing end 42 also comprises a guiding surface 49 which has an inwardly extending conical profile which leads to a peripheral extremity 46 that is tapered in relation to a longitudinal axis of the fluid transfer device 40.

Figure 2:
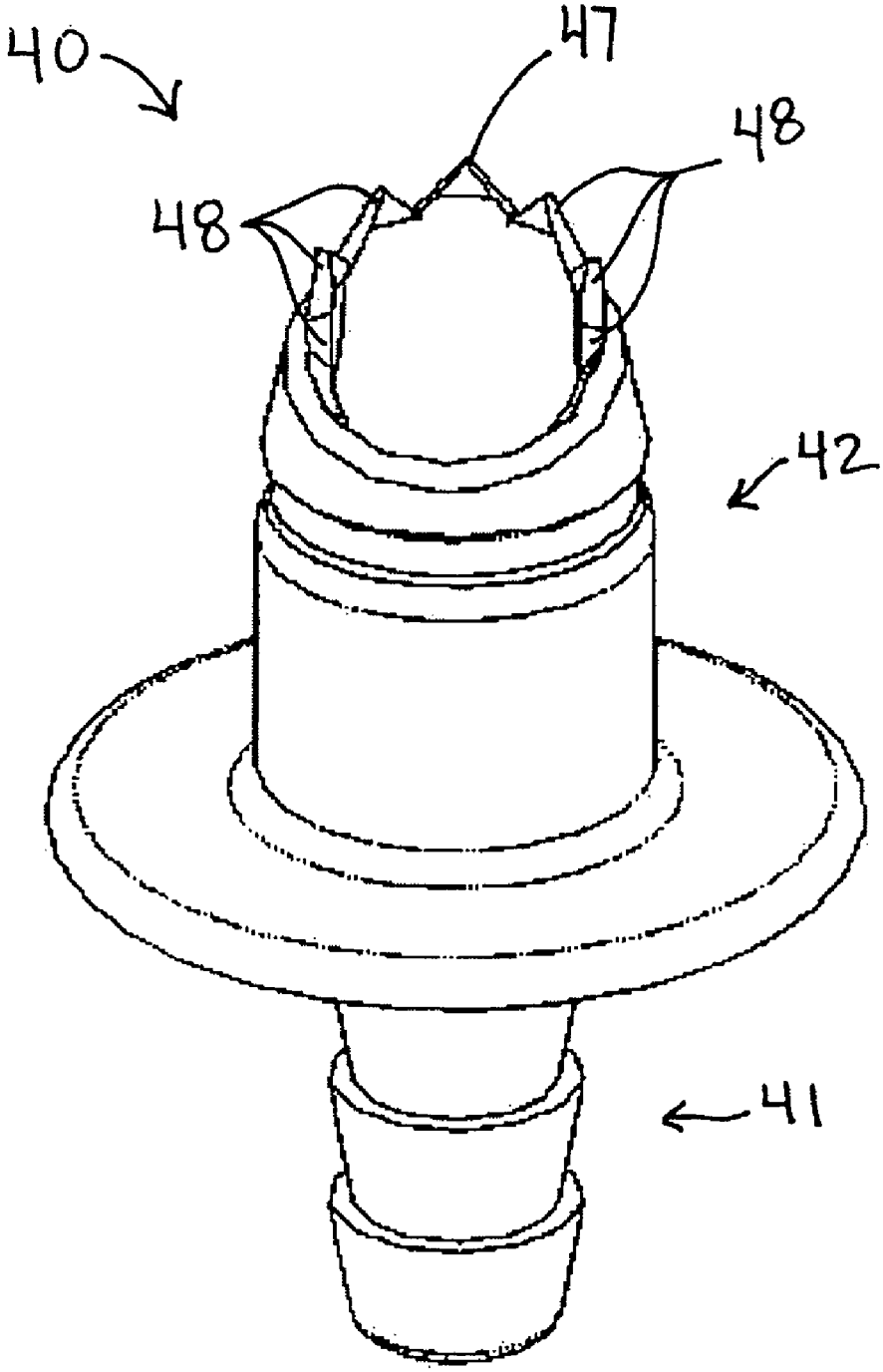
FIG. 2 shows a perspective view of the fluid transfer device of the piercing fitment assembly of FIG. 1.
Figure 3:
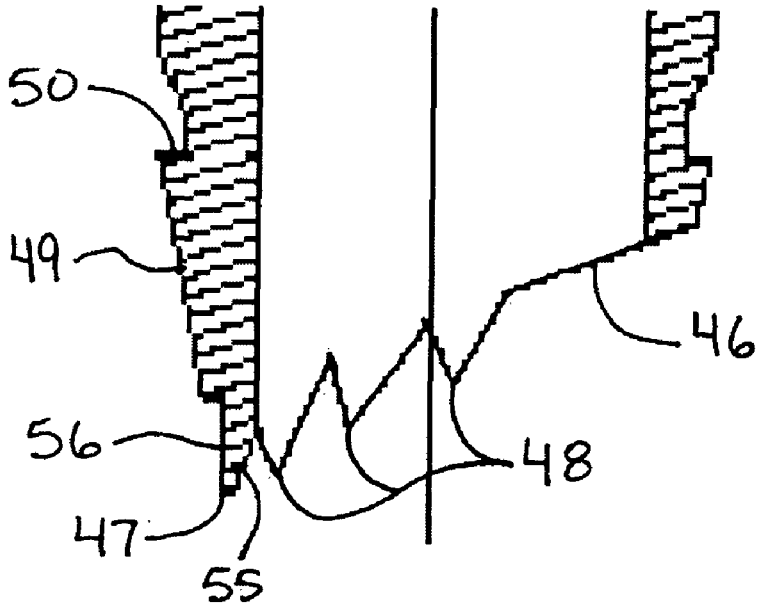
FIG. 3 shows a cross-sectional side elevation view of a piercing end of the fluid transfer device of the piercing fitment assembly of FIG. 1.
Figure 9:
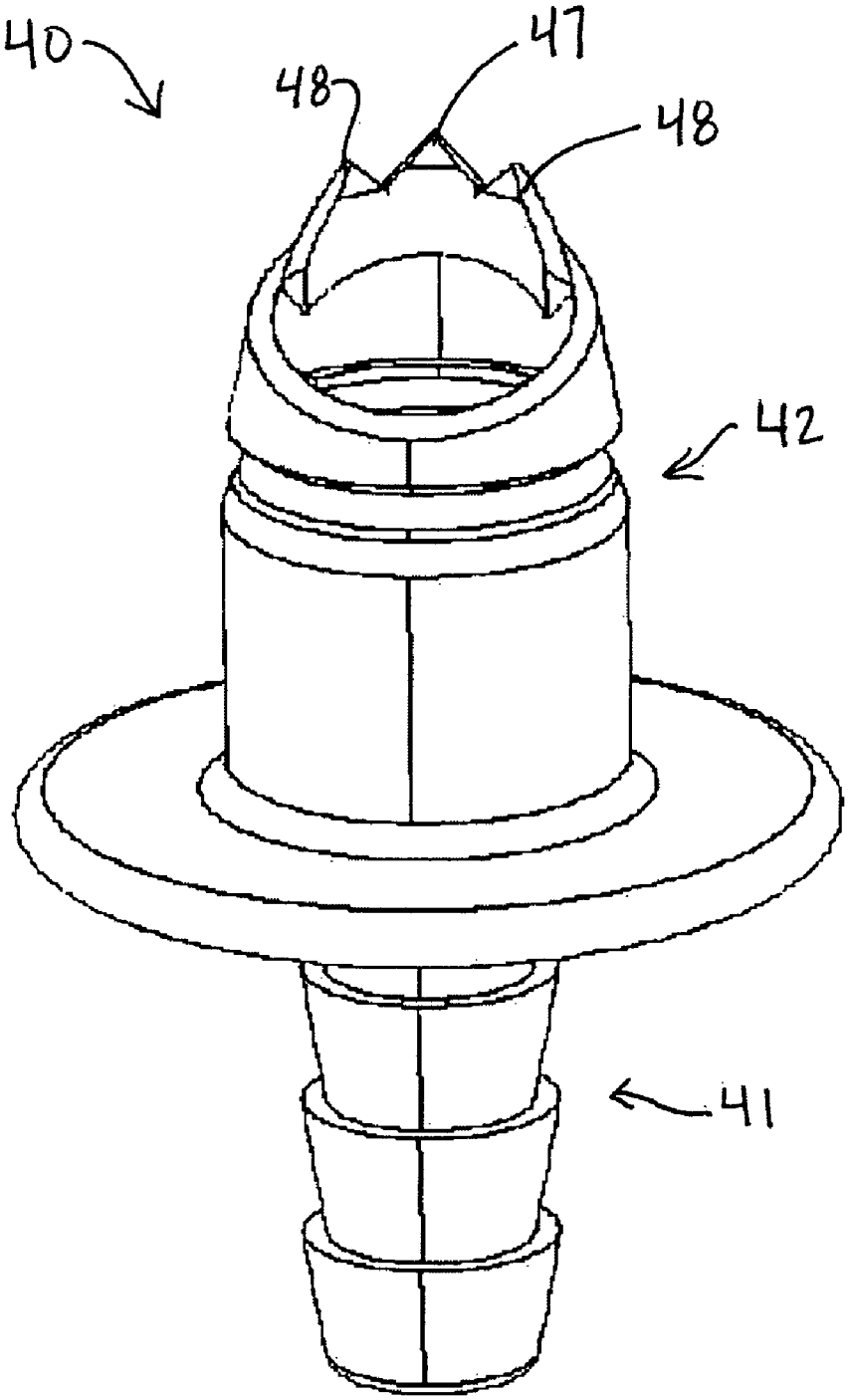
FIG. 9 shows a perspective view of a fluid transfer device according to another embodiment of the invention.
Figure 10:
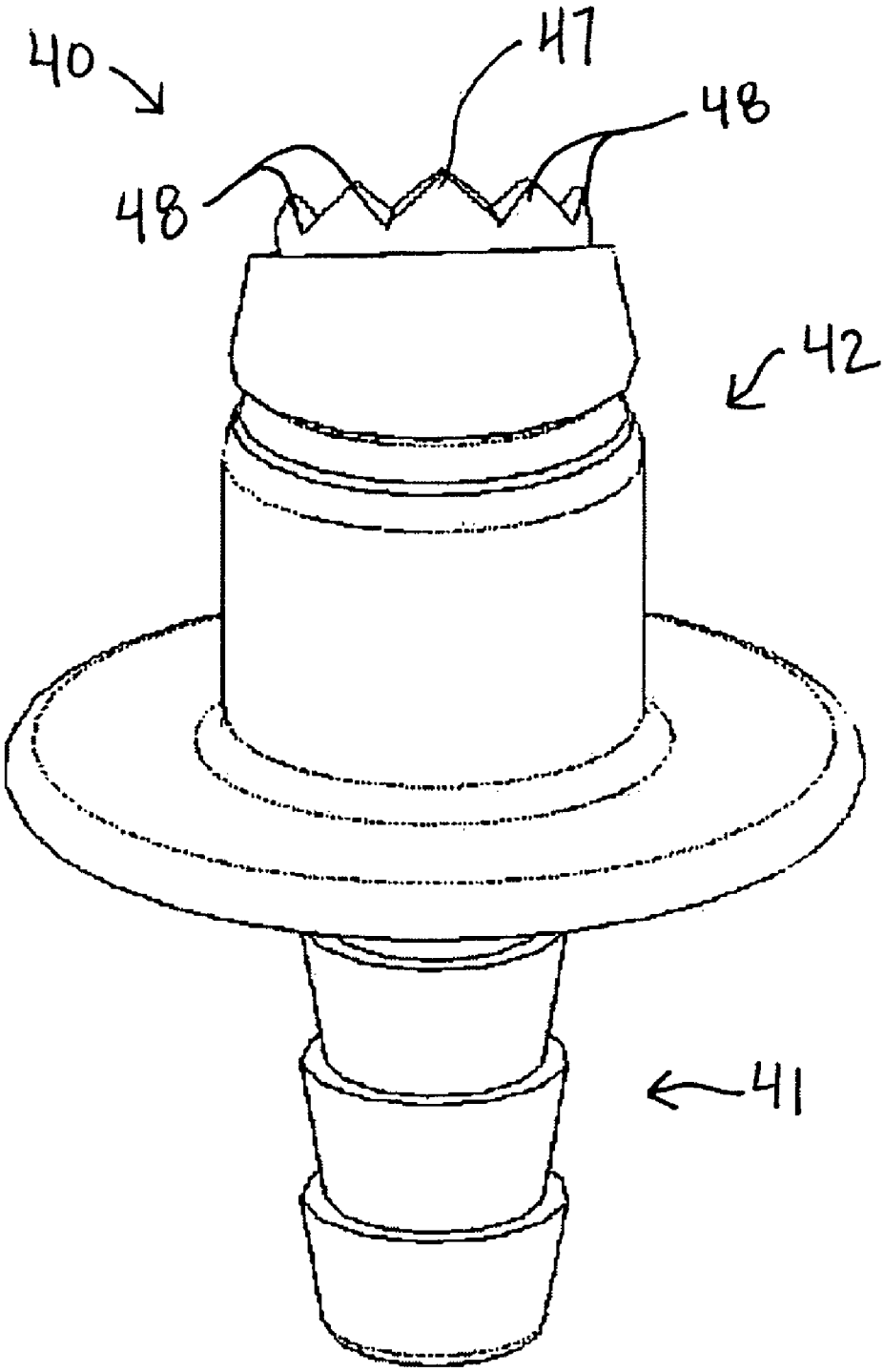
FIG. 10 shows a perspective view of a fluid transfer device according to another embodiment of the invention.

The fluid transfer device 40 further comprises at a minimum, a leading tooth 47 located at a distal extrema 53 of the tapered peripheral extremity 46 and in a preferred embodiment, includes a plurality of additional teeth 48 which are disposed around the peripheral extremity 46 of the piercing end 42. The configuration of the teeth (47 and 48) is shown in details in FIGS. 2 and 3. The leading tooth 47 comprises an exterior surface 56 which is relatively parallel to the longitudinal axis of the fluid transfer device 40 and an interior surface 55 which is inwardly inclined and forms an angle of 10° to 45° with the exterior surface 56. The additional teeth 48 may have the same or different geometric features as the leading tooth 47. The leading tooth 47 and the additional teeth 48 may comprise a total number of teeth of 3, 5, 7, etc. FIG. 9 shows a fluid transfer device having 3 teeth and FIG. 10 shows a fluid transfer device having 5 teeth.

Filling of flexible containers such as the ones used in bag-in-box systems may be performed on any suitable aseptic filler known to those skilled in the art, and is typically performed using commercial packaging systems such as, for example, the Liqui-Box™ Filler Model 2000C1T-A (not shown). Before filling and aseptic packaging, the container 2 is supplied to the packaging system in a state where the inside of the container has been pre-sterilized using Cobalt gamma irradiation or any other suitable means of sterilization. The spout 10, cap 20 and fluid transfer device 40 are also sterilized using Hydrogen Peroxide ($H_2O_2$), steam or any other suitable means. Once the container 2 has been filled via the spout 10 with flowable material, the cap 20, comprising a barrier 21 hermetically bonded to the top surface 23, is secured to the spout 10. The fluid transfer device 40 is provided to the customer together with the filled and capped container in a separate sterilized plastic bag (not shown) which is only opened when the contents of the container 2 are to be dispensed.

Figure 5:
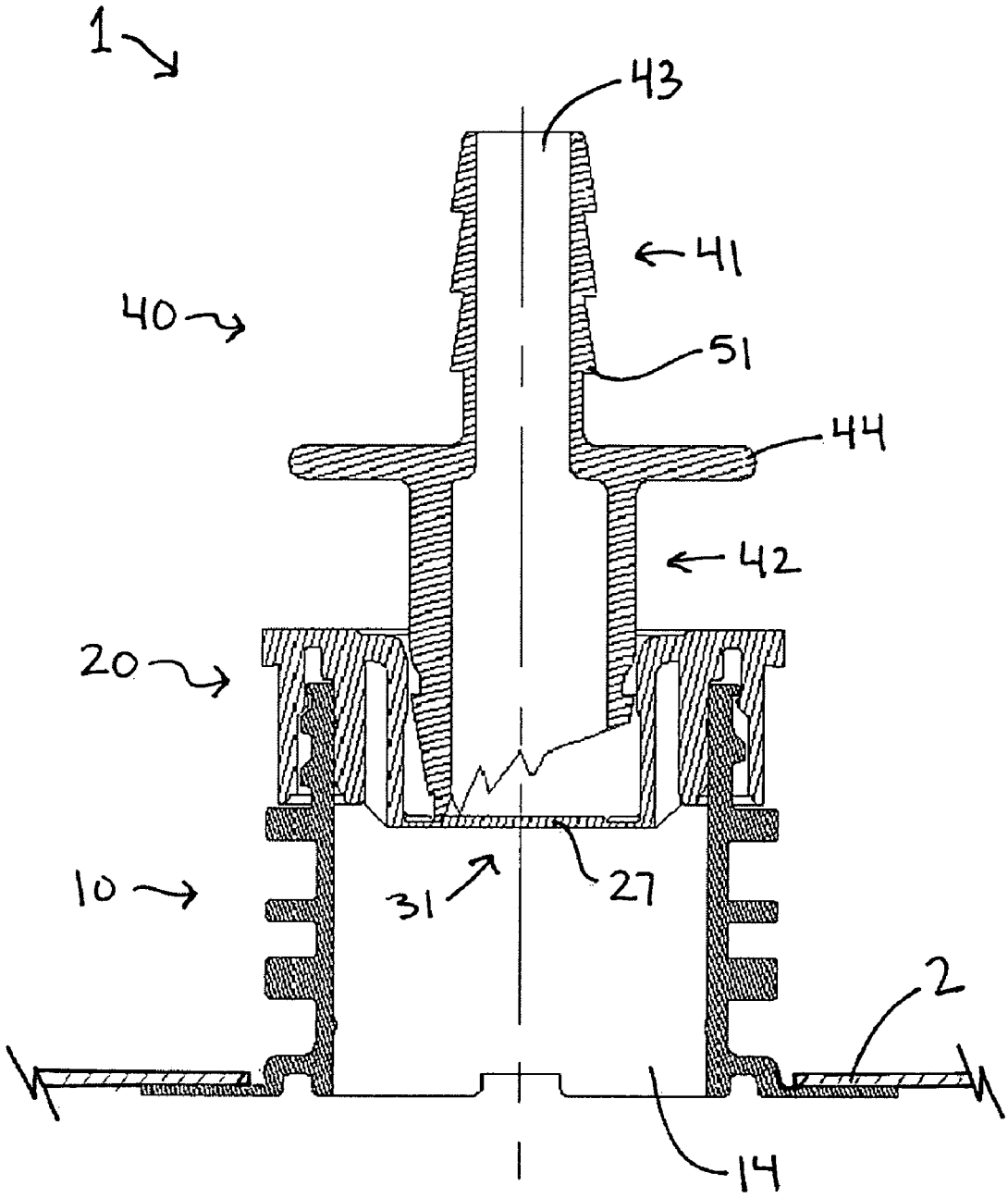
FIG. 5 shows a cross-sectional side elevation view of the piercing fitment assembly of FIG. 1 in a ready-to-pierce state.

FIG. 5 shows the cap 20 installed on the spout 10 of the flexible container 2. The cap 20 is installed in a snap-fitting manner by firstly positioning the cap 20 and the spout 10 such that the spout-receiving annular opening 26 receives the end of the spout 10. An inward axial force is applied to the cap 20 such as to press the cap 20 against the spout 10. The annular bead 15 forcefully and resiliently slides against the inside surface 25 and forms a substantially hermetic seal between the cap 20 and the spout 10. Once the cap 20 is installed on the spout 10, the annular bead 24 on the cap 20 cooperates with the outwardly projecting flange 13 on the spout 10 such as to lock the cap 20 into position.

The barrier 21 maintains the central opening 22 and the pierceable portion 31 of the cap 20 in a substantially sterile state during shipping and storage of the container. Preferably, the barrier 21 may be substantially gas or oxygen impermeable and may include any suitable material such as foil, ethylene vinyl alcohol, polyvinyl alcohol, polyethylene or a metalized polyester laminate. The barrier 21 may be attached to the top surface 23 of the sterilized cap 20 by heat sealing, ultrasonic welding or other known methods. The barrier 21 may be removed prior to piercing the pierceable portion 31 of the cap 20 or it may be left on the cap 20 and pierced using the fluid transfer device 40.

Figure 6:
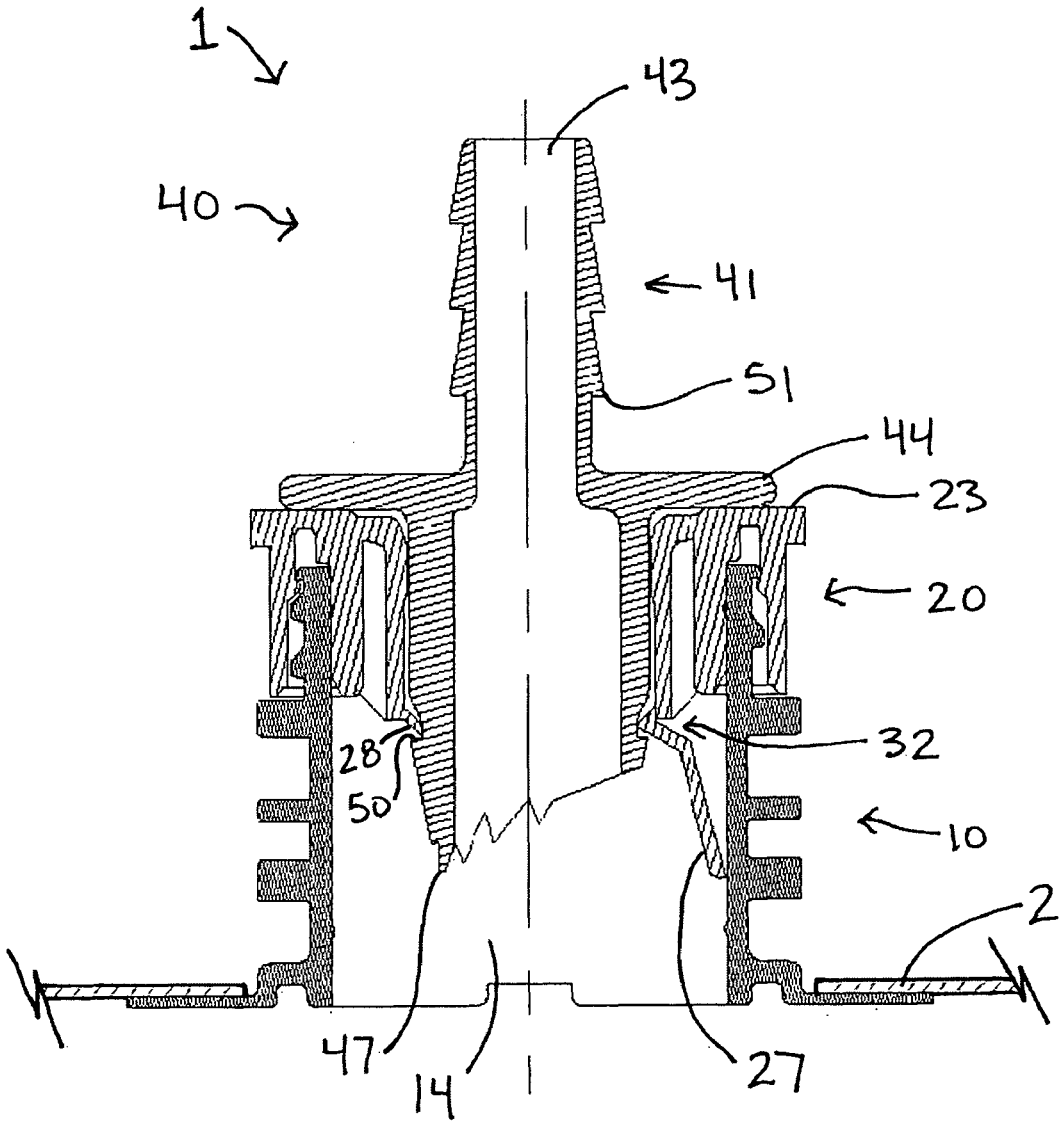
FIG. 6 shows a cross-sectional side elevation view of the piercing fitment assembly of FIG. 1 in a dispensing state.

The container 2 would usually be placed in a dispensing position wherein the fitment assembly 1 extends outwardly or downwardly from the container so as to allow gravity to aid in dispensing of the contents. The contents of the container 2 are dispensed by firstly removing the barrier 21 from the cap 20. The fluid transfer device 40 is then removed from the sterilized plastic bag (not shown) and the dispensing end 41 may be connected to a dispensing tube (not shown) or other fluid delivery systems. The piercing end 42 of the fluid transfer device 40 is inserted into the central opening 22 and pressed axially inwardly towards the cap 20, using the handle 44, such as to pierce the pierceable portion 31. FIG. 5 shows the fluid transfer device 40 positioned within the central opening 22 of the cap 20 in a position ready to pierce the pierceable portion 31 of the cap 20. FIG. 6 shows the fluid transfer device 40 in a dispensing position within the cap 20 wherein the pierceable portion 31 has been fully pierced. Alternatively, depending on the type of material used for the barrier 21, the barrier 21 may be left in place and pierced using the fluid transfer device 40 before piercing the pierceable portion 31 of the cap 20.

The leading tooth 47 and the additional teeth 48 permit a relatively effortless piercing of the pierceable portion 31 by concentrating the force at distinct points on the pierceable portion 31 and hence facilitating the piercing process. The leading tooth 47 firstly punctures the circular portion 33 of the indentation and as the piercing end 42 of the fluid transfer device 40 is further inserted, the additional teeth 48 subsequently come in contact with and puncture the circular portion 33 in a progressive manner so as to leave the circular membrane 27 hingedly attached to the cap 20. The additional teeth 48 need not have the same geometric configuration as the leading tooth 47. In the present embodiment, the leading tooth 47 and the additional teeth 48 are shown to have a generally pyramidal geometry, however, any other suitable geometric configurations which minimize the force required to pierce the pierceable portion may be used.

Figure 7:
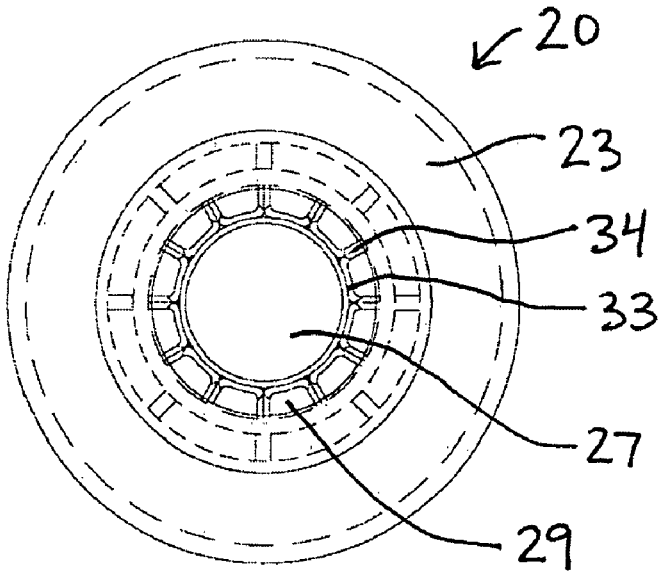
FIG. 7 shows a top plan view of a cap of a piercing fitment assembly according to another embodiment.

As the leading tooth 47 punctures the circular portion 33 of the indentation, it proceeds in tearing the circular portion 33 as the interior surface 55 presses downwardly and radially inwardly on the circular membrane 27 so as to peel back the circular membrane 27 from the pierceable portion 31. As the guiding surface 49 proceeds to enter the pierceable portion 31, the petaloid elements 29 are pushed and deflected downwardly and thereby cause the material within the radial portions 34 of the indentation to become stretched. Consequently, this creates a tight fit between the piercing end 42 and the pierceable portion 31 of the cap 20 and thereby prevents unwanted leakage. In FIG. 4, the petaloid elements 29 are shown to have a generally square profile but a more rounded profile as shown in FIG. 7 can also be used.

Once the fluid transfer device 40 is fully inserted, the bottom surface 45 of the handle 44 comes in contact with the top surface 23 of the cap 20 and the fluid transfer device 40 becomes locked into a dispensing position within the cap 20 via a snap-fitting mechanism. The petaloid elements 29 and the stretched radial portions 34 of the indentation become engaged with the annular recessed portion 50 of the fluid transfer device 40 as shown in FIG. 6. This prevents the fluid transfer device 40 from being pulled out from the cap 20 once the piercing fitment assembly 1 is in a dispensing state and also maintains a tight fit between the cap 20 and the fluid transfer device 40 to prevent unwanted spillage.

FIG. 6 clearly shows how the circular membrane 27 remains connected to the cap 20 via a hinge 32. Through the cooperation of the piercing end 42 of the fluid transfer device 40 and the pierceable portion 31 of the cap 20, the hinge 32 is automatically formed upon piercing and comprises a portion of the pierceable portion 31 which remains unbroken once the fluid transfer device 40 has been fully inserted and locked into the dispensing position. The circular membrane 27 is thereby prevented from becoming loose and potentially obstructing the flow or being dispensed together with the contents.

The location of the hinge 32 within the pierceable portion 31 is dependent on the orientation of the fluid transfer device 40 when piercing occurs as the hinge 32 is automatically formed at a location adjacent to a proximal extrema 54 of the peripheral extremity 46. Therefore, the piercing end 42 of the fluid transfer device 40 does not have to be inserted into the cap 20 in any particular orientation for the hinge 32 to be formed.

Figure 8:
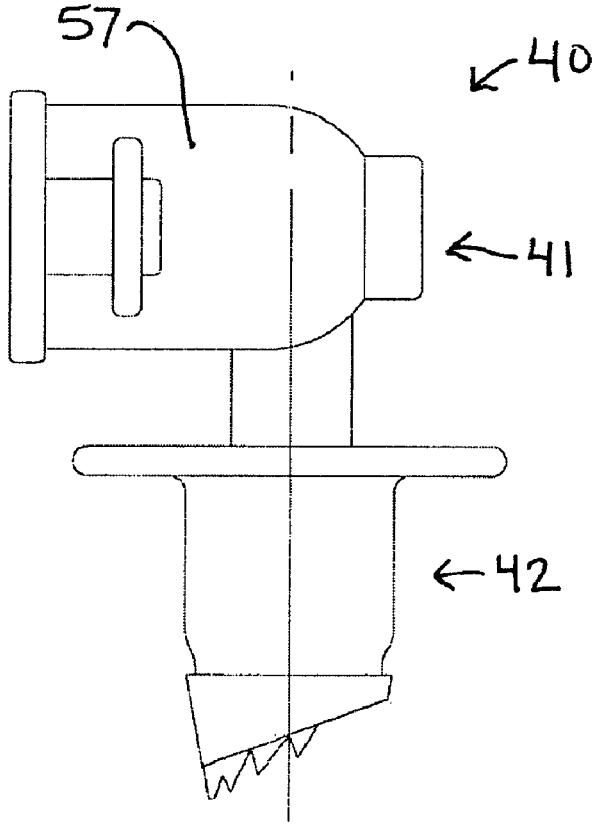
FIG. 8 shows a side elevation view of a fluid transfer device of a piercing fitment assembly according to another embodiment.

The ribbed exterior portion 51 of the dispensing end 41 shown in the preferred embodiment is adapted to receive a dispensing tube (not shown). Obviously, other types of adapters could also be used for connecting the fluid transfer device 40 to a delivery system. The dispensing end 41 could also be in fluid communication with a dispensing tap which could be used to regulate the flow of flowable material. In another embodiment, the dispensing end 41 may also comprise a dispensing tap 57 as shown in FIG. 8 that is integral to the fluid transfer device 40.

Figure 11:
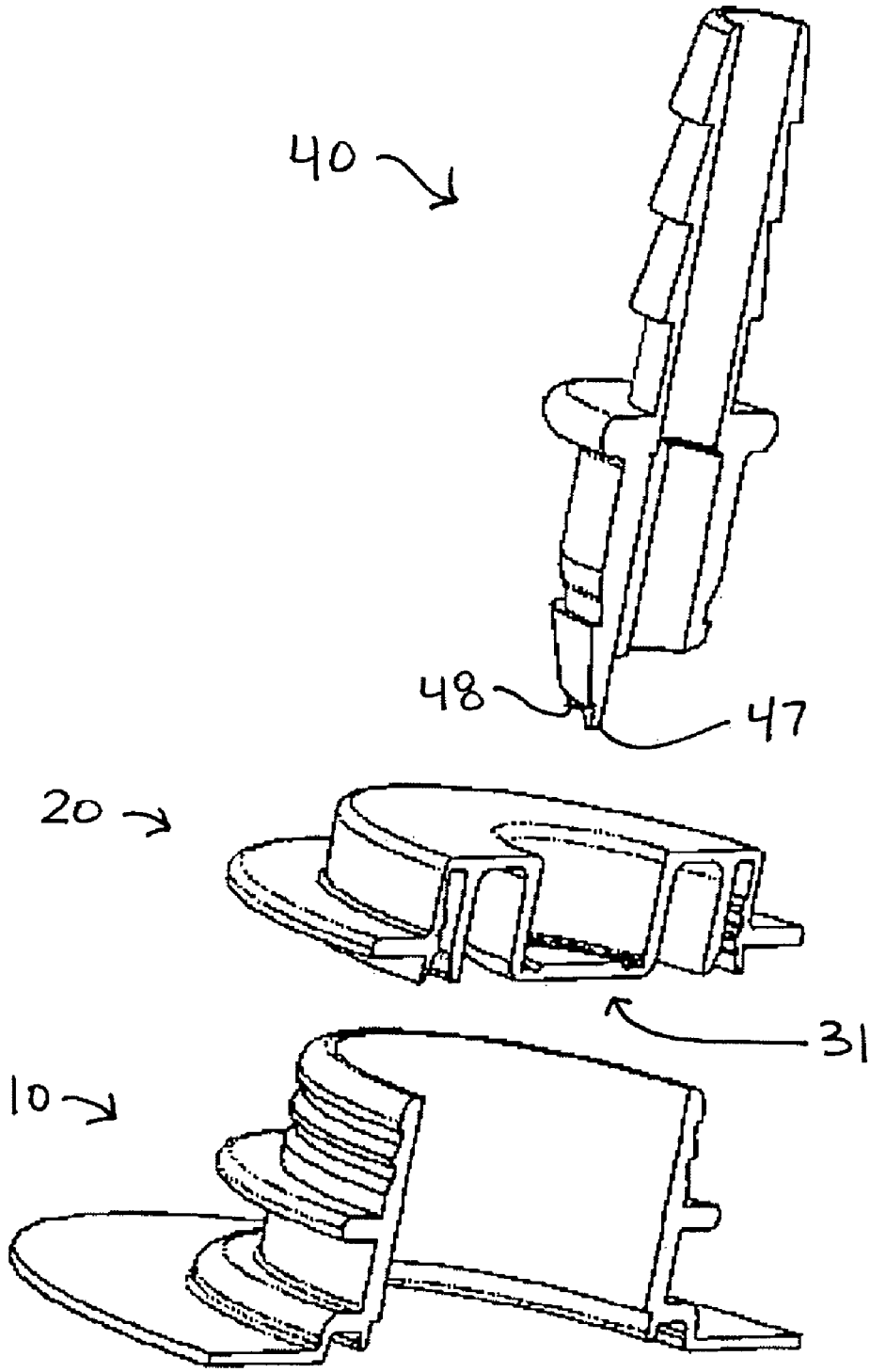
FIG. 11 shows a cross-sectional perspective view of a piercing fitment assembly, in a disassembled state, according to a another embodiment of the invention.
Figure 12A:
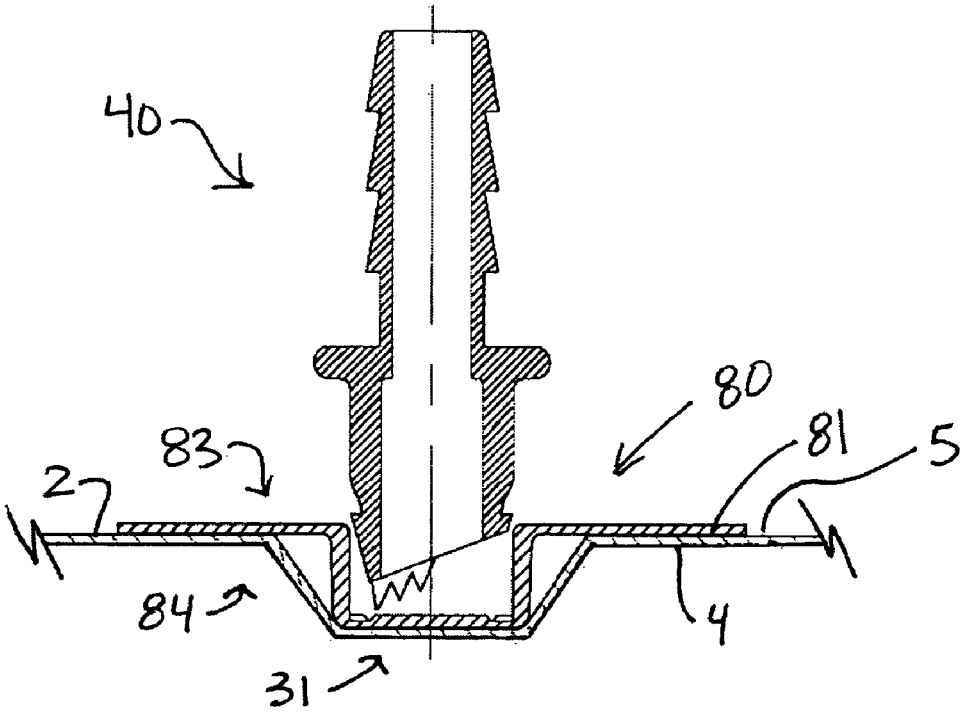
FIG. 12A shows a cross-sectional side elevation view of a piercing fitment assembly according to another embodiment of the invention.
Figure 12B:
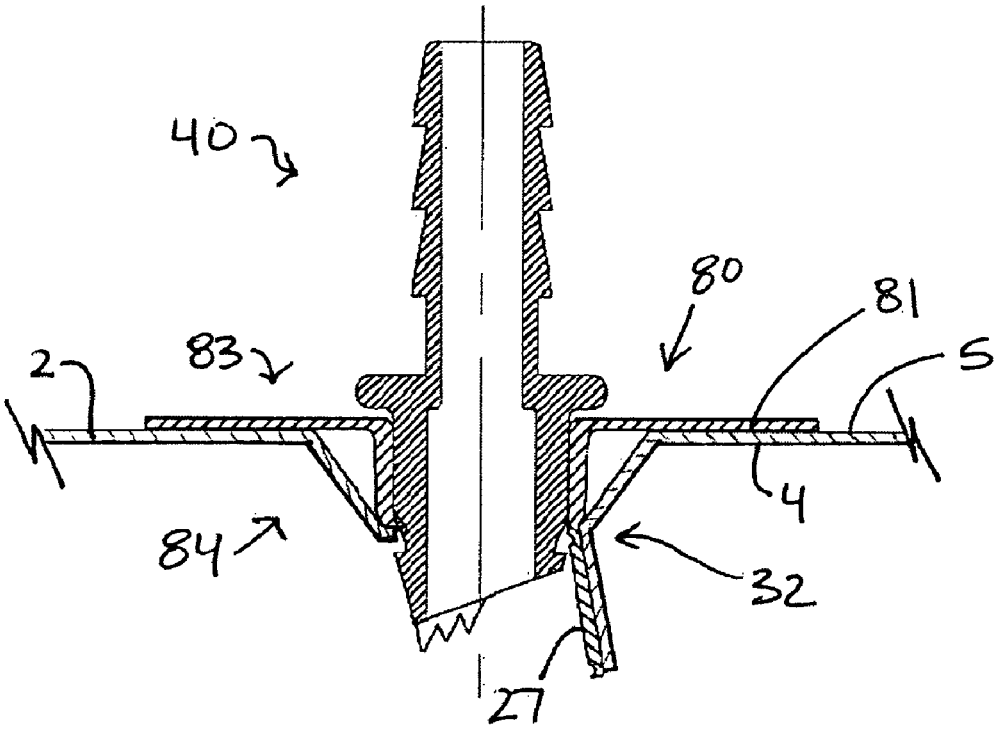
FIG. 12B shows a cross-sectional side elevation view of the piercing fitment assembly of FIG. 12A in a dispensing state.
Figure 13A:
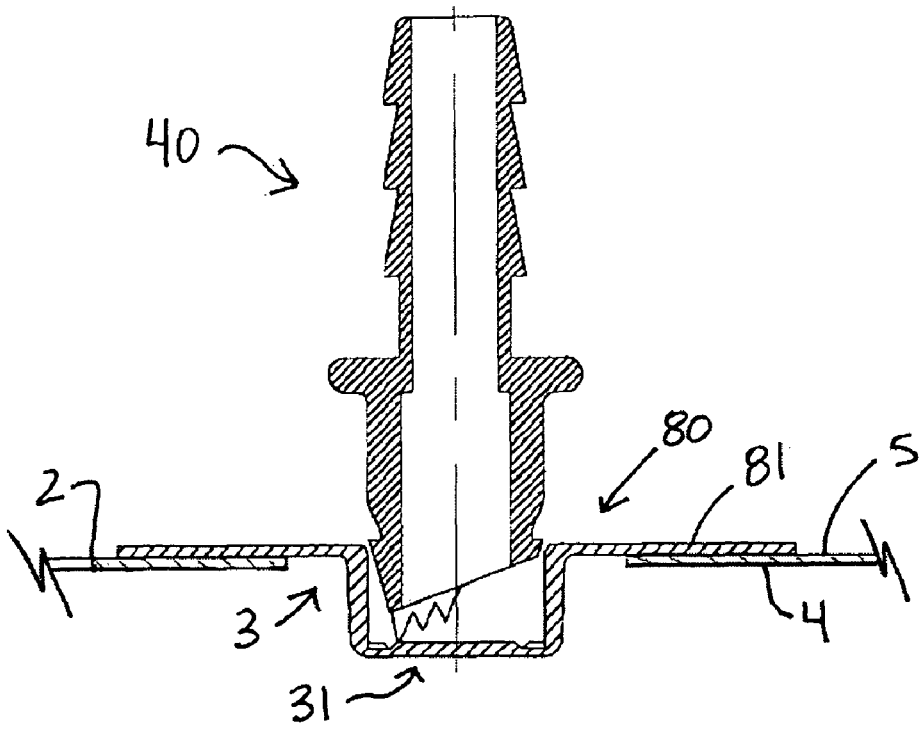
FIG. 13A shows a cross-sectional side elevation view of a piercing fitment assembly according to another embodiment of the invention.
Figure 13B:
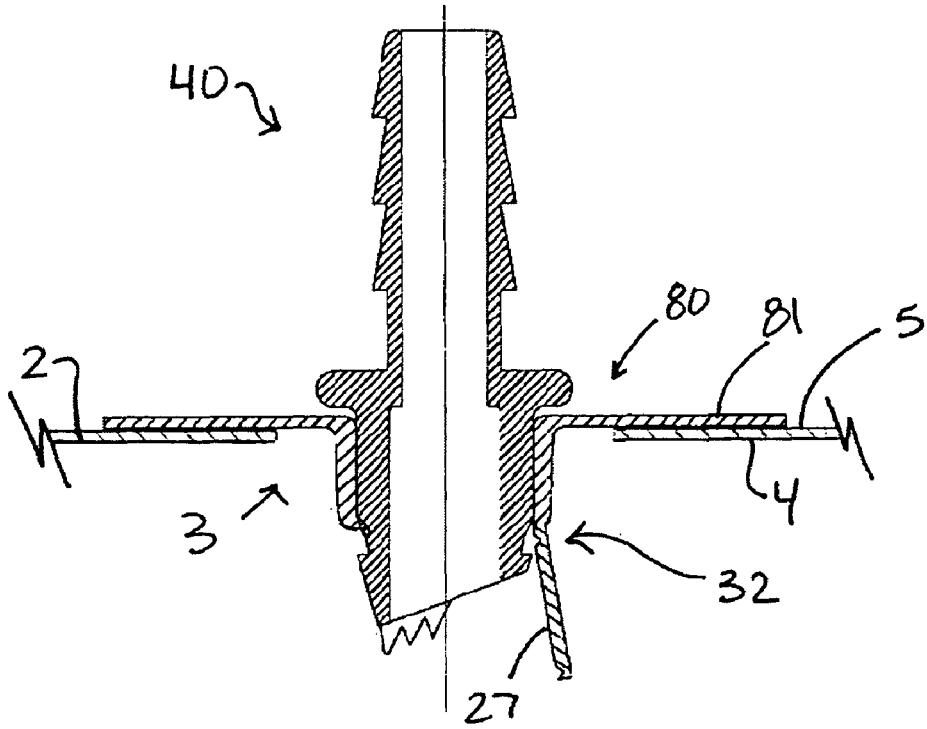
FIG. 13B shows a cross-sectional side elevation view of the piercing fitment assembly of FIG. 13A in a dispensing state.

FIG. 11 shows a piercing fitment assembly according to another embodiment that is mainly used for dairy applications. The cap 20 in this case has a slightly different geometric configuration but still comprises the pierceable portion 31 adapted to be pierced by the fluid transfer device 40.

Figure 16A:
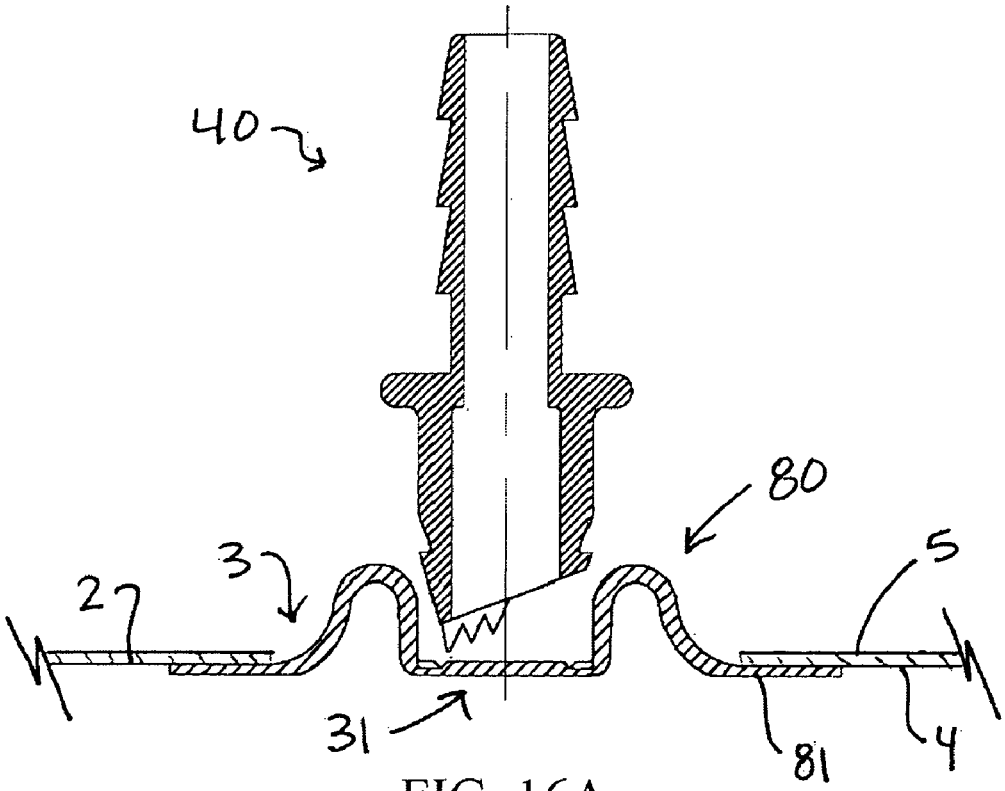
FIG. 16A shows a cross-sectional side elevation view of a piercing fitment assembly according to another embodiment of the invention.
Figure 16B:
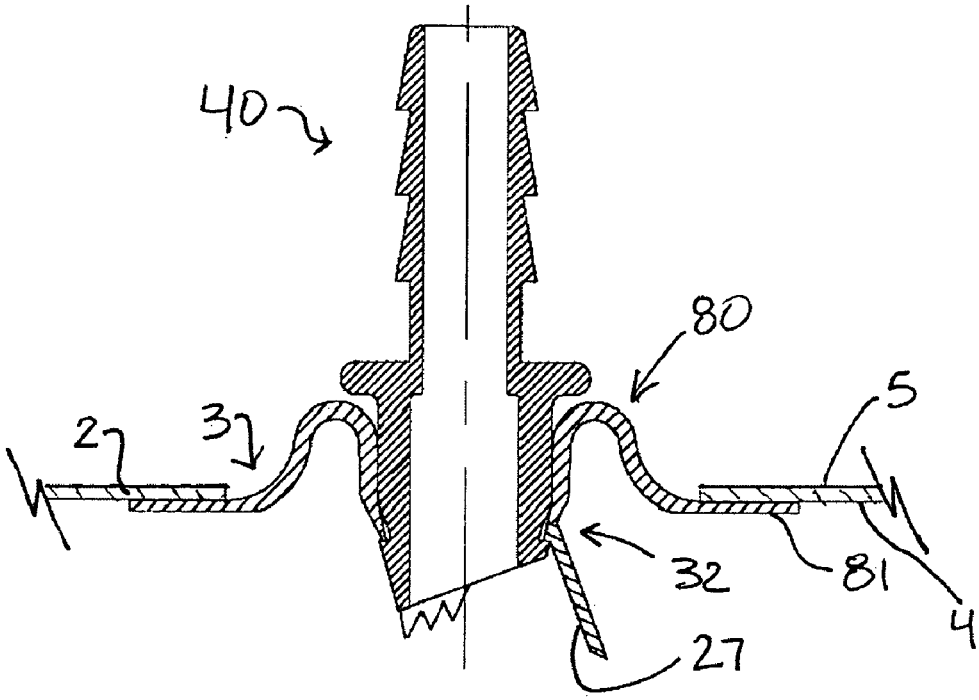
FIG. 16B shows a cross-sectional side elevation view of the piercing fitment assembly of FIG. 16A in a dispensing state.

In yet another embodiment, the present invention also provides a piercing fitment assembly wherein a pierceable port is secured directly to a wall of a flexible container. Examples of such pierceable ports are shown generally at 80 in FIGS. 12A to 16B. This type of pierceable port can be used, for example, on containers that are filled on vertical form film seal filling machines where no spout is needed for filling the containers. The pierceable port 80 comprises a flange 81 that is adapted for securing the pierceable port 80 to an outside wall surface 5 (shown in FIGS. 12A to 15B) or an inside wall surface 4 (shown in FIGS. 16A and 16B) of the container 2. The pierceable port also comprises an exterior side generally shown at 83, a container side generally shown at 84, and, a pierceable portion 31 that is adapted to be pierced by the fluid transfer device 40 as previously described. Similarly, the pierceable port may also comprise the barrier 21 secured to the exterior side 83 in order to keep the pierceable portion 31 in a substantially sterile state prior to dispensing the contents of the container 2.

Figure 14A:
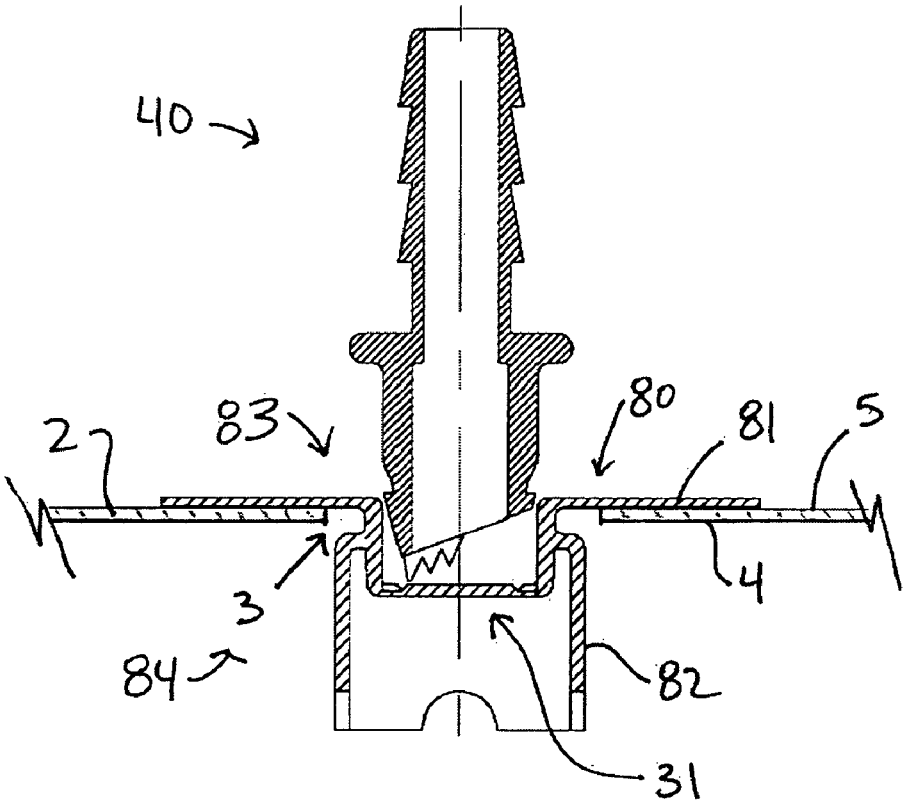
FIG. 14A shows a cross-sectional side elevation view of a piercing fitment assembly according to another embodiment of the invention.
Figure 14B:
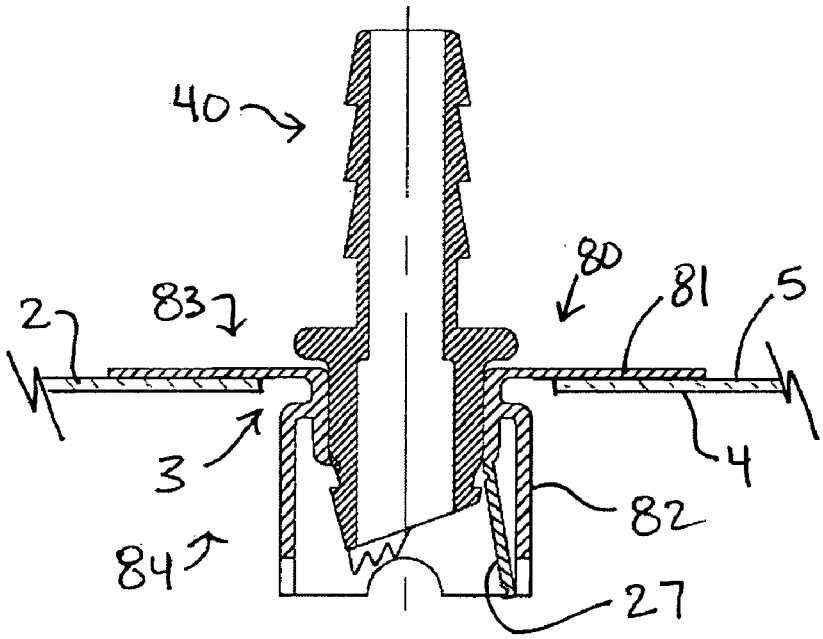
FIG. 14B shows a cross-sectional side elevation view of the piercing fitment assembly of FIG. 14A in a dispensing state.
Figure 15A:
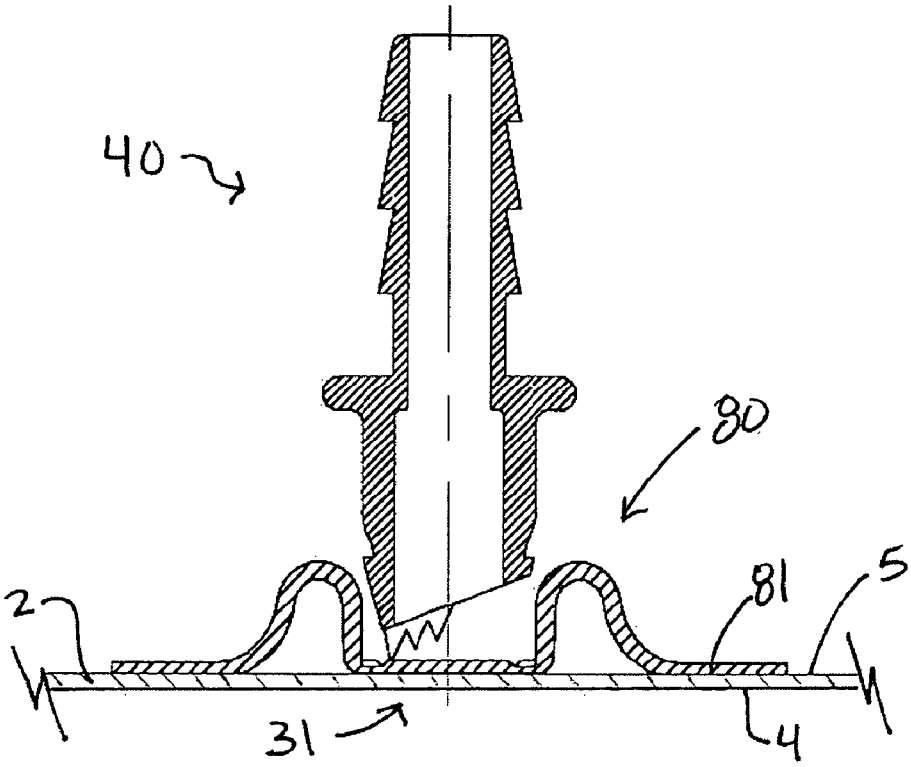
FIG. 15A shows a cross-sectional side elevation view of a piercing fitment assembly according to another embodiment of the invention.
Figure 15B:
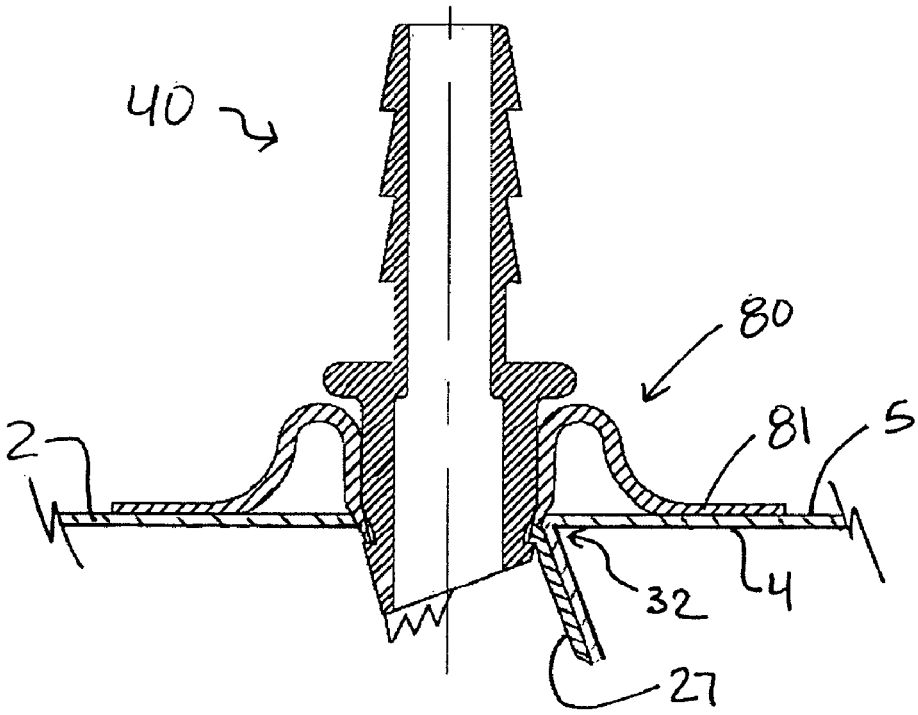
FIG. 15B shows a cross-sectional side elevation view of the piercing fitment assembly of FIG. 15A in a dispensing state.

FIGS. 14A and 14B show the pierceable port 80 according to another embodiment which comprises a skirt 82. The skirt extends outwardly from a container side 84 of the pierceable port 80 and surrounds the pierceable portion 31. The skirt 82 serves as a spacer or guard to keep any portion of any adjacent container wall away from the pierceable portion 31 thereby preventing the container 2 from being pierced by the fluid transfer device 40.

FIGS. 13A, 13B, 14A, 14B, 16A and 16B show embodiments of pierceable ports 80 that are secured to the container 2 either on an outside wall surface 5 or an inside wall surface 4 at a location where the pierceable portion 31 is aligned with an opening 3 in the container 2. However, as shown in FIGS. 12A, 12B, 15A and 15B, the pierceable portion does not have to be aligned with an opening 3 in the container 2 if the flange 81 is secured to the outside wall surface 5. In such a case, it is preferable that at least a portion of the pierceable portion 31 also be secured to the outside wall surface 5. This prevents excessive stretching of the container material in the area of the pierceable portion during piercing and allows the container 2 to be pierced more easily by the fluid transfer device 40.

Since these containers are typically intended for one-time use and are discarded once the contents of such containers have been completely dispensed, it is preferable that the fitment assembly for use in such systems be easy to manufacture, inexpensive, easy to install and use, and recyclable. It is also important that the components are of sufficient quality and robustness. Accordingly, the construction of the components required to produce the piercing fitment assembly of the present invention is relatively simple and economical. The spout 10, cap 20, pierceable port 80 and fluid transfer device 40 can all be produced from commonly used and recyclable thermoplastic materials and formed using conventional plastic injection molding processes. For example, the cap 20 and pierceable port 80 may preferably be made using a blend of 85% medium density linear low density polyethylene (LDPE) and 15% high density polyethylene (HDPE). The fluid transfer device 40 may be produced using high density polyethylene (HDPE) or polypropylene (PP). Alternatively, the fluid transfer device 40 may be made using a commercially available low density polyethylene. It was found that the use of a softer low density polyethylene for the fluid transfer device 40 in comparison with HDPE causes the force required to pierce the cap 20 or pierceable port 80 to be reduced. It is believed that the use of a softer material for the fluid transfer device 40 allows the piercing end 42 of the fluid transfer device 40 to be more accommodating to a rupture path, in the piercing portion 31, that offers less resistance during piercing. The reduction in piercing force was more notable on caps 20 and pierceable ports 80 having a pierceable portion 31 of comparatively smaller diameter.

Thinner regions of injection molded parts typically impose challenges with respect to suitable mold and process design for injection molding. Accordingly, the thinner circular potion 33 and radial portions 34 of the pierceable portions 31, may be formed using a separate punch (not shown) used to score or indent the cap 20 or pierceable port 80 once it has been molded with thicker dimensions. The punch can preferably be integrated within the mold wherein the forming of the thinner regions may take place prior to or as the part is ejected from the mold. The specific configuration of such a mold with integrated punch would be apparent to one skilled in the art.

From the foregoing description, it can be seen that the present invention comprises a piercing fitment assembly which is used with flexible containers. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

The invention claimed is:

1. A fluid transfer device for dispensing flowable material from a container by piercing, comprising:

(A) a hollow body, said hollow body having:

(a) a longitudinal axis, (b) a through internal passage, (c) a piercing end, and (d) a dispensing end wherein said dispensing end is adapted to receive a dispensing tube;

wherein said piercing end has a peripheral extremity that is tapered in relation to said longitudinal axis of said hollow body;

wherein said piercing end also has a leading tooth that is located at a distal extrema of said peripheral extremity so as to initiate piercing and wherein said leading tooth comprises an exterior surface substantially parallel to said longitudinal axis of said hollow body and an interior surface inclined inwardly and forming an angle of 10° to 45° with said exterior surface and wherein said piercing end further comprises a plurality of additional teeth disposed around said peripheral extremity.

2. A fluid transfer device as recited in claim 1, wherein the total number of teeth comprises 3, 5 or 7.

3. A fluid transfer device as recited in claim 1, wherein said dispensing end comprises a tap.

4. A fluid transfer device as recited in claim 1, wherein said piercing end of said hollow body comprises an annular recessed portion used for locking said fluid transfer device in a dispensing position, cooperatively with a cap of said container.

5. A cap for securing to the spout of a container, said cap comprising:

(A) a spout-receiving side adapted for securing said cap to said spout of said container; and (B) an essentially flat pierceable portion adapted to be pierced by a fluid transfer device; wherein said pierceable portion is located within a central opening of the cap and wherein said cap further comprises a barrier covering said pierceable portion and secured to said exterior side of said cap such as to cover said central opening wherein and said barrier includes a substantially gas-impermeable material selected from one of following: ethylene vinyl alcohol, polyvinyl alcohol, foil, polyethylene, and metalized polyester laminate; and wherein said pierceable portion comprises an indentation defining a circular membrane surrounded by a plurality of petaloid elements.

6. A fitment assembly for a container, comprising:

(A) a spout connected in fluid communication to said container;

(B) a cap sealing an end of said spout, said cap comprising:

(I) a spout-receiving side adapted for securing said cap to said spout of said container; and (II) an essentially flat pierceable portion adapted to be pierced by a fluid transfer device; wherein said pierceable portion is located within a central opening of the cap and wherein said cap further comprises a barrier covering said pierceable portion and secured to said exterior side of said cap such as to cover said central opening wherein said barrier includes a substantially gas-impermeable material selected from one of following: ethylene vinyl alcohol, polyvinyl alcohol, foil, polyethylene, and metalized polyester laminate; and wherein said pierceable portion comprises an indentation defining a circular membrane surrounded by a plurality of petaloid elements; and (C) a fluid transfer device, having a longitudinal axis and a through internal passage, for piercing said cap at said pierceable portion to permit fluid communication from said container through said spout and said fluid transfer device;

wherein said fluid transfer device comprises a piercing end and a dispensing end, wherein said piercing end has a peripheral extremity that is tapered in relation to said longitudinal axis of said fluid transfer device, wherein said leading tooth is located at a distal extrema of said tapered peripheral extremity so as to initiate piercing of said pierceable portion of said cap during piercing and wherein said piercing end comprises a leading tooth to initiate piercing of said pierceable portion of said cap and further comprises a plurality of additional teeth disposed around said peripheral extremity of said piercing end such as to subsequently and progressively puncture said pierceable portion of said cap during piercing; and whereby when said piercing end pierces said pierceable portion, the plurality of petaloid elements form a tight fit between the piercing end and the pierceable portion.

7. A fitment assembly as recited in claim 6, wherein said total number of teeth comprises 3, 5 or 7.

8. A fitment assembly as recited in claim 6, wherein said leading tooth comprises an exterior surface substantially parallel to said longitudinal axis of said fluid transfer device, and, an interior surface inwardly inclined and forming an angle of 10° to 45° with said exterior surface.

9. A fitment assembly as recited in claim 6, further comprising a tube fitted to said dispensing end of said fluid transfer device.

10. A fitment assembly as recited in claim 6, wherein said dispensing end comprises a dispensing tap.

11. A fitment assembly as recited in claim 6, wherein said pierceable portion is adapted to cooperate with said fluid transfer device such that said circular membrane remains hingedly connected to said cap after piercing.

12. A fitment assembly as recited in claim 6, further comprising a locking mechanism adapted to secure said fluid transfer device and said cap together as a result of a pushing force exerted on said fluid transfer device in an essentially axial direction within said spout, whereby said piercing end is in piercing engagement with said cap.

13. A fitment assembly as recited in claim 12, wherein said locking mechanism comprises an annular recessed portion on said piercing end of said fluid transfer device adapted to cooperate with said petaloid elements of said pierceable portion of said cap.

14. A pierceable port for a flexible container, comprising:

a pierceable portion adapted to be pierced by a fluid transfer device;

wherein said pierceable portion comprises an indentation defining a circular membrane surrounded by a plurality of petaloid elements and wherein said pierceable portion is located within a central opening and further comprises a barrier on an exterior side of said pierceable port and covering said pierceable portion and further comprises a skirt extending outwardly from a container side of said pierceable port and surrounding said pierceable portion.

15. A flexible container comprising said pierceable port of claim 14, wherein said pierceable port is secured to said flexible container and said pierceable portion is aligned with an opening in said flexible container.

16. A flexible container comprising said pierceable port of claim 14, wherein said pierceable port is secured to said flexible container by a flange secured to a wall surface of said flexible container.

17. A flexible container comprising said pierceable port of claim 14, wherein said pierceable port is secured to an outside wall surface of said flexible container and a portion of said pierceable portion is also secured to said outside wall surface.

18. A fitment assembly for a container comprising:

(A) a pierceable port secured to a wall of said container, and, having a pierceable portion said pierceable portion adapted to be pierced by a fluid transfer device;

wherein said pierceable portion comprises an indentation defining a circular membrane surrounded by a plurality of petaloid elements and wherein said pierceable portion is located within a central opening and further comprises further comprising a barrier on an exterior side of said pierceable port and covering said pierceable portion and further comprises a skirt extending outwardly from a container side of said pierceable port and surrounding said pierceable portion; and (B) a fluid transfer device having a through internal passage to permit fluid communication from said container through said fluid transfer device;

wherein said pierceable port includes a flange by which it is secured to said container.

* * * * *